United States Patent [19]

Hyakutake

[11] 4,226,156

[45] Oct. 7, 1980

[54] PERCUSSION INSTRUMENT WITH ELECTRIC PICKUP UNIT

[75] Inventor: Seiichi Hyakutake, Hamamatsu, Japan

[73] Assignee: Nippon Gakki Seizo Kabushiki Kaisha, Japan

[21] Appl. No.: 16,957

[22] Filed: Mar. 5, 1979

[30] Foreign Application Priority Data

Mar. 9, 1978 [JP] Japan ..... 53-29083[U]

[51] Int. Cl.[3] ..... G10H 3/14

[52] U.S. Cl. ..... 84/1.14; 84/411 M; 84/DIG. 12; 84/DIG. 24

[58] Field of Search ..... 84/1.04, 1.06, 1.14, 84/DIG. 12, DIG. 24, 411 M

[56] References Cited

U.S. PATENT DOCUMENTS

| | | | |
|---|---|---|---|
| 3,725,561 | 4/1973 | Paul | 84/DIG. 12 |
| 3,956,959 | 5/1976 | Ebihara et al. | 84/DIG. 12 |

*Primary Examiner*—S. J. Witkowski

*Attorney, Agent, or Firm*—Ostrolenk, Faber, Gerb & Soffen

[57] ABSTRACT

An electric percussion instrument having at least one drum head is provided with a mute assembly arranged near the drum head and at least one mechanical-electric convertor containing a vibration responsive pickup element is incorporated into the mute assembly. Direct collection of the drum head vibrations via the mute assembly successfully precludes undesirable mixing of external vibratory noises which are transmitted to the drum frame.

9 Claims, 8 Drawing Figures

PERCUSSION INSTRUMENT WITH ELECTRIC PICKUP UNIT

BACKGROUND OF THE INVENTION

The present invention relates to an improved electric percussion instrument having an electric pickup unit. More particularly, the present invention relates to an improvement in a vibration pickup system for electric percussion instruments in which mechanical vibrations of at least one drum head are collected by at least one vibration responsive pickup unit and converted into corresponding electric signals for generation of musical tones after proper electric processing.

With the recent development of electric string instruments (such as electric pianos and electric guitars), there has been an increasing demand for electric percussion and wind instruments which can be played with the electric string instruments in order to have a balance in tone volume during musical performances.

In order to fulfill this requirement, percussion instruments are normally provided with vibration responsive pickup units which are attached directly to or arranged near a vibratory part of the instrument. The vibration responsive pickup unit recieves mechanical vibrations generated by the vibratory part and converts the vibrations into corresponding electric signals which are electrically processed to generate musical tones. In this way, the mechanical vibrations of the vibratory part of the percussion instrument can be received directly and more colorful tones can be generated than possible using natural tones caused by pneumatic vibrations. This also results in a remarkable amplification of the tone volume since the obtained electric signals are processed through one or more electric amplifiers.

Using a simple switching operation, an electric percussion instrument can be converted into a natural percussion instrument. When using the instrument as an electric percussion instrument, it is desirable to eliminate the generation of natural tones which are not electrically picked up. In practice, a mute assembly is attached to the instrument in order to partly or fully mute the natural tones and generate electric tones only. In operation, the mute assembly is brought into tight contact with either surface of the drum head. Change in contact pressure between the mute assembly and the drum head influence the vibration of the drum head and causes a corresponding change in tone colour of the musical tones generated by the instrument.

With the conventional pickup system, it is impossible to pick up mechanical vibrations of the drum head and at the same time eliminate the natural tone since the vibration responsive pickup unit is usually arranged remote from the mute element. Intended muted tones cannot be picked up by such a system. This seriously deteriorates the acoustic effect of the percussion instruments. Further, when the vibration responsive pickup unit is mounted on the drum frame of the instrument, external vibratory noises transmitted to the drum frame are also undesirably collected by the vibration responsive pickup unit on the drum frame, thereby non-negligibly degrading the acoustic effect of the instrument.

SUMMARY OF THE INVENTION

It is one object of the present invention to provide an electric percussion instrument which is capable of collecting muted electric musical tones while at the same time blocking the generation of natural tones despite its relatively simple construction.

It is another object of the present invention to provide an electric percussion instrument which enables direct pickup of vibrations transmitted to the mute assembly from the drum head while successfully avoiding an undesirable mixing of external vibratory noises.

It is the other object of the present invention to provide an electric percussion instrument which affords different acoustic effects for vibrations at different portions of the drum head.

In accordance with the present invention, a mute assembly operative on a drum head internally contains one or more mechanical-electric convertors each including a vibration responsive element such as a piezoelectric element and coupled to a given electric signal processing circuit. In a preferred embodiment, two or more mute assemblies may be arranged so that they operate on different portions of a drum head, each mute assembly internally containing a mechanical-electric converter.

DETAILED DESCRIPTION OF THE PREFERRED EMBODIMENTS

Figure 1:
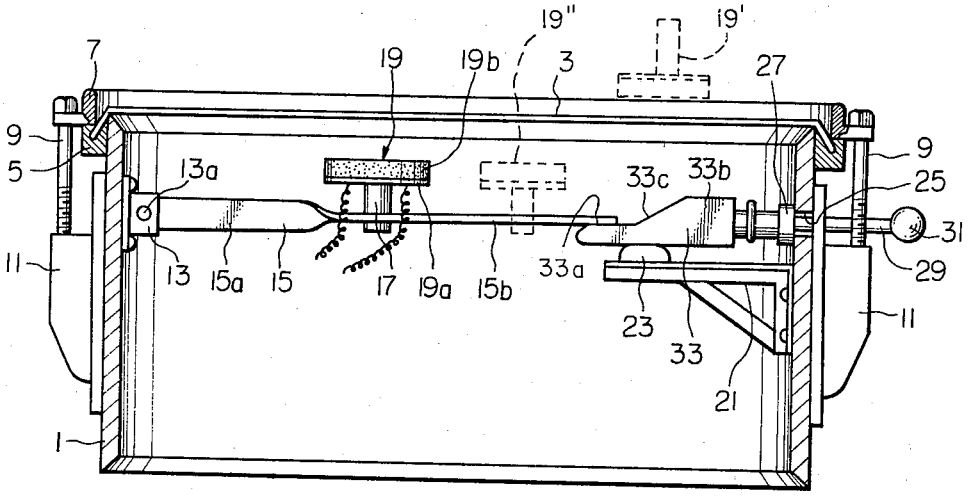
FIG. 1 is a side view, partially in section, of a percussive instrument to which the present invention is advantageously applicable.

One embodiment of an electric percussion instrument constructed in accordance with the principles of the present invention is shown in FIG. 1. One open end, i.e. the upper open end in the illustrated embodiment, of a cylindrical drum frame 1 is covered by a drum head 3 which is made of a flexible material such as polyester resin, polycarbonate resin or natural animal skins. The drum head 3 is connected to a ring 5 which is in contact with the outer peripheral surface of the drum frame 1 near its open end. An annular tensioning frame 7 is located on the top surface of the ring 5 and is coupled to drum frame 1 by a plurality of tensioning screws 9 and a corresponding plurality of lugs 11. The screws 9 extend downward through the outer rim portion of the tensioning frame 7 and are in screw engagement with the corresponding lugs 11 which are arranged on the outer peripheral surface of the drum frame 1. By properly adjusting the tension of screws 9, the drum head 3 is placed in a prescribed tensioned state corresponding to a required tonal pitch.

Within the cavity defined by the drum frame 1, a bracket 13 is fixed to the inner peripheral surface of the drum frame and pivotally carries a supporting member 15 about its pivot 13*a*. The supporting member 15 extends substantially horizontally and diametrally towards the corresponding opposite inner peripheral surface of the drum frame 1. At a proper position on its length, the supporting member 15 fixedly carries an upright post 17 which in turn carries a mute assembly 19. The mute assembly 19 is located facing the inner surface, i.e. the under surface, of the drum head 3.

The mute assembly 19 includes a substrate 19*a* mounted on top of the upright post 17, and a mute element 19*b* mounted on the substrate 19*a*. The mute element 19*b* is made of a flexible material such as felt, synthetic rubber or foamed resin.

In the illustrated embodiment, the supporting member 15 takes the form of an elongated flat plate made of a rigid material. At a position between the pivot 13*a* and the mute assembly 19, the supporting menber 15 is twisted approximately its longitudinal axis by about 90 degrees. As a result, the section 15*a* of the supporting member 15 closer to the pivot 13*a* is in a plane substantially normal to the drum head 3 while the section 15*b* remote from the pivot 13*a* is in a plane substantially parallel to the drum head 3. More specifically, the section 15*a* is in a substantially vertical plane while the section 15*b* is in a substantially horizontal plane. This twisted construction of the supporting member 15 assures enhanced bending stiffness thereof despite its cantilever type support.

At a position diametrally opposite to the bracket 13, a shelf 21 is fixed to the inner peripheral surface of the drum frame 1. Shelf 21 carries a pad 23 mounted to the top surface thereof. At a position somewhat above the shelf 21, a radial through hole 25 is formed in the drum frame 1 and a boss 27 is attached to the inner opening of the through hole 25. An operating rod 29 is inserted ideally through the hole 25 and the boss 27 while extending horizontally and radially towards the axis of the drum frame 1. A knob 31 is fixed to the outer end of the operating rod 29 to permit a manual operation of the mute assembly 19 as described below.

A cam element 33 is fixed to the inner end of the above-described operating rod 29 while slidably lying on the pad 23 on the shelf 21. The top surface of the cam element 33 includes a lower cam surface 33*a* closer to the axis of the drum frame 1, a higher cam surface 33*b* remote from the axis and an incline 33*c* connecting the two cam surfaces. In the inoperative position of the mute assembly 19, the operating rod 29 is manually pulled outwards, the free end of the supporting member 15 lies on the lower cam surface 33*a* of the cam element 33, the supporting member 15 keeps a substantially horizontal position, and the mute assembly 19 is separated from the drum head 3. In order to place the mute assembly 19 into the operative position, the operating rod 29 is manually pushed inwards, the free end of the supporting member 15 rides on the higher cam surface 33*b* of the cam element 33 passing the incline 33*c*, the supporting member 15 swings upwards, and the mute element 19*b* of the mute assembly 19 is brought into tight contact with the lower surface of the drum head 3 in order to damp mechanical vibrations to be generated by the drum head 3.

In accordance with the present invention, one or more mechanical-electric converters are incorporated into the mute assembly, which convert collected mechanical vibrations into corresponding output electric vibrations. Generally, such a mechanical-electric converter includes a piezo-electric element and a pair of electrodes attached to the piezo-electric element. Piezo-electric elements usually used as pickups for electric pianos may be advantageously used for this purpose.

Figure 2A:
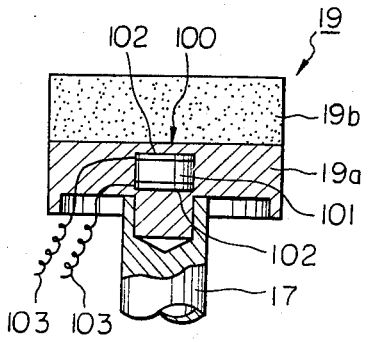
FIG. 2A is a side sectional view of one embodiment of the mute assembly usable for the percussive instrument shown in FIG. 1.

One embodiment of the mute assembly 19 internally provided with a mechanical-electric converter 100 is shown in FIG. 2A. The mechanical-electric converter 100 is fully embedded within the substrate 19*a* of the mute assembly 19 and includes a piezo-electric element 101 and a pair of electrodes 102 sandwiching the piezo-electric element. Leads 103 are provided in order to connect the electrodes 102 to a later described electric circuit for processing the electric outputs from the converter 100.

Figure 2B:
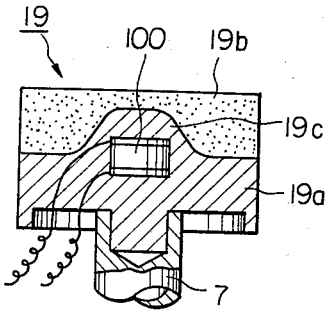
FIG. 2B is a side sectional view of another embodiment of the mute assembly usable for the percussion instrument shown in FIG. 1.

Another embodiment of the mute assembly 19 internally provided with a mechanical-electric converter 100 is shown in FIG. 2B. In this case, the substrate 19*a* has a bulge 19*c* projecting into the mute element 19*b* and the mechanical-electric converter 100 is embedded within the bulge 19*c*. The reduced thickness of the mute element 19*b* minimizes transmission loss of mechanical vibrations during its travel from the drum head 3 to the converter 100 through the mute element 19*b*, thereby greatly enhancing responsiveness of the converter 100.

The substrate 19*b* of the mute assembly 19 may advantageously be manufactured by ordinary synthetic resin molding and the converter 100 may be placed in the substrate 19*b* simultaneously with molding.

Figure 3:
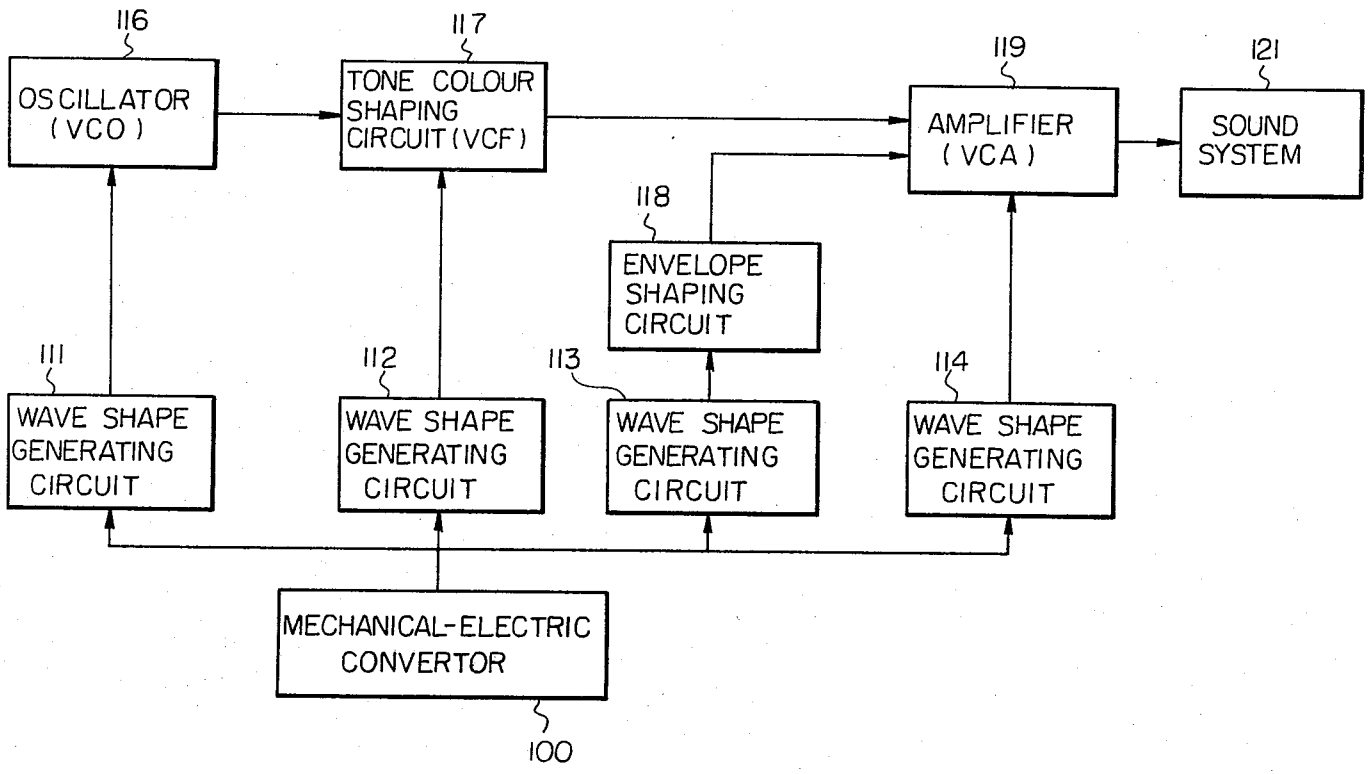
FIG. 3 is a block diagram of one embodiment of the electric signal processing circuit usable in combination with the percussive instrument shown in FIG. 1.

One embodiment of the electric circuit for processing the electric outputs from the mechanical-electric converter 100 is shown in FIG. 3. The leads 103 of the converter 100 are coupled in parallel to input terminals of four wave shape generating circuits 111 through 114.

The output terminal of the first wave shape generating circuit 111 is coupled to a VCO (voltage controlled oscillator) 116 whose output terminal is in turn coupled to one input terminal of a VCF (voltage controlled filter) or tone colour shaping circuit 117.

The output terminal of the second wave shape generating circuit 112 is coupled to the other input terminal of the above-described tone colour shaping circuit 117.

The output terminal of the tone colour shaping circuit 117 is coupled to one input terminal of a VCA (voltage controlled amplifier) 119.

The output terminal of the third wave shape generating circuit 113 is coupled to another input terminal of the amplifier 119 via an envelope shaping circuit 118.

The output terminal of the fourth wave shape generating circuit 114 is coupled to the other input terminal of the amplifier 119 which is in turn coupled to a sound system 121 such as a speaker.

Figure 4A:
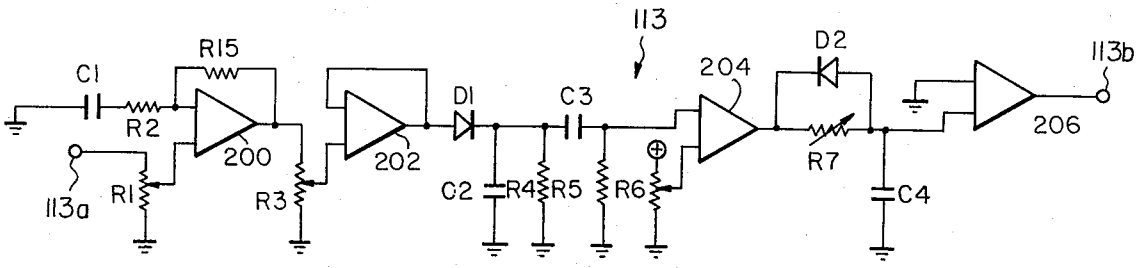
FIGS. 4A and 4B are circuit diagrams of examples of wave shape generating circuits used in the processing circuit shown in FIG. 3.

One practical example of the third wave shape generating circuit 113 is shown in FIG. 4A, in which the input terminal 113*a* is coupled to the leads 103 from the mechanical-electric converter 100 whereas the output terminal 113*b* is coupled to the envelope shaping circuit 118.

As shown in FIG. 4A, the output of mechanical-electric converter 100 is applied to one input of operational amplifier 200 via a potentiometer R1. The remaining input of amplifier 200 is coupled to ground via a capacitive network including a resistor R2 and a capacitor C1. A resistor R15 is coupled in the feedback loop of amplifier 200.

The output of amplifier 200 is applied to one input of operational amplifier 202 via a second potentiometer R3. The remaining input of amplifier 202 is coupled to its output such that amplifier 202 acts as a voltage follower.

The output of amplifier 202 is applied to a filter network including capacitors C2, C3 and resistors R4 and R5 via diode D1. The ouput of the filter network is applied to one input of operational amplifier 204 whose remaining input receives a biasing voltage via potentiometer R6.

The output of amplifier 204 is coupled to a variable resistor R7 which is shunted by a diode D2 and a capacitor C4. Resistor R7 is also coupled to one input of operational amplifier 206 whose remaining input is grounded. The output of amplifier 206 is coupled to output terminal 113*b*.

Figure 4B:
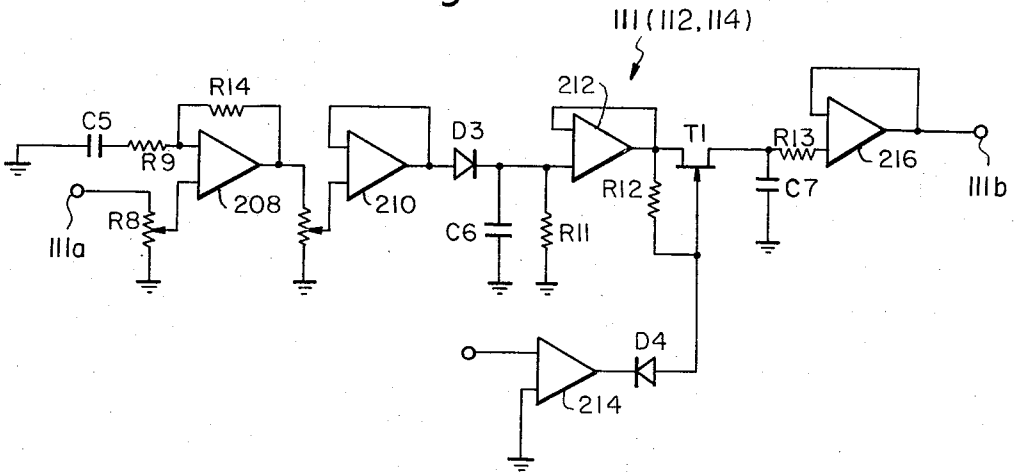

One practical example of the first wave shape generating circuit 111 is shown in FIG. 4B, in which the input terminal 111*a* is coupled to the leads 103 from the mechanical-electric converter 100 whereas the output terminal 111*b* is coupled to the oscillator 116. The circuit construction shown in FIG. 4B is also applicable to the second and fourth wave shape generating circuits 112 and 114 with obvious changes in the terminal connections.

As shown in FIG. 4B, the output of mechanical-electrical converter 100 is applied to one input of operational amplifier 204 via potentiometer R8. The remaining input of amplifier 208 is coupled to ground via resistor R9 and capacitor C5. A resistor R14 is coupled in the feedback loop of amplifier 208. The output of amplifier 208 is applied to the input of operational amplifier 210 via potentiometer R10. The remaining input of amplifier 210 is coupled to its output such that amplifier 210 operates as a voltage follower.

The output of amplifier 210 is applied to a second operational amplifier 212 via a filter circuit including capacitor C6 and resistor R11 via diode D3. The output of amplifier 212, which is connected to operate as a voltage follower, is applied directly to the drain of a field effect transistor T1 and is applied to the base of transistor T1 via resistor R12. The base of transistor T1 is also coupled to operational amplifier 214 via diode D4.

The source of transistor T1 is coupled to the input of operational amplifier 212 via capacitor C7 and resistor R13. The remaining input of amplifier 216 is coupled to its output such that amplifier 216 operates its voltage follower.

In modified constructions, one or more, but not all, of the wave shape generating circuits may be omitted in accordance with requirement in practice. The envelope shaping circuit 118 may be coupled to the first and/or second wave shape generating circuit 111, 112.

With the mute assembly 19 in the inoperative position, the mute element 19*b* is separate from the under surface of the drum head 3 and the converter 100 does not respond to the mechanical vibrations of the drum head 3. Performance is carried out without any muting.

When the mute element 19*b* is in tight contact with the under surface of the drum head 3 due to manual operation on the outside knob 31, the pressure acting on the mechanical-electric conductor 100 varies as the drum head 3 vibrates so that the converter 100 generates electric signals corresponding to the pressure variation. As the vibration of the drum head 3 is constrained due to the tight contact with the mute assembly 19, natural tones are partly or fully muted and only electric tones are picked up.

Since the mechanical-electric converter 100 is arranged within the mute assembly 19 itself, vibrations of the drum head 3 and the mute element 19*b* can be directly picked up by the converter 100. Consequently, electric signals to be generated from the converter 100 more exactly corresponds to the vibrations of the drum head 3 and the mute element 19*b* than in the prior art construction in which their vibrations are picked up on the drum frame 1. In addition, the mechanical-electric converter 100 is almost completely sheltered against any external vibrations transmitted to the drum frame 1. Thus, the percussive instrument in accordance with the present invention can generate ideally beautiful tones free of noises. Further, by properly adjusting the capacity of the amplifier 119, tones having any required tone volume can be generated. Use of the tone colour shaping circuit 117 in the signal processing circuit enables generation of tones having complicated tone colours. Change in material for the mute element 19*b* assures various changes in tone quality.

In a modified embodiment of the present invention, the mute assembly 19 may be arranged outside the drum frame 1 with corresponding change in construction of means for selectively urging the mute assembly 19 to contact with the drum head 3. In this case, the mute assembly 19 is arranged for selective contact with the outer surface, i.e. the top surface of the drum head 3. This is shown in phantom in FIG. 1 as mute assembly 19'.

While a piezo-electric element 101 is used as the vibration responsive element in the above-described embodiments, any other vibration responsive element such as a pressure sensor, can be used as long as the element is capable of converting collected mechanical vibrations into corresponding output electric vibratory signals.

Figure 5:
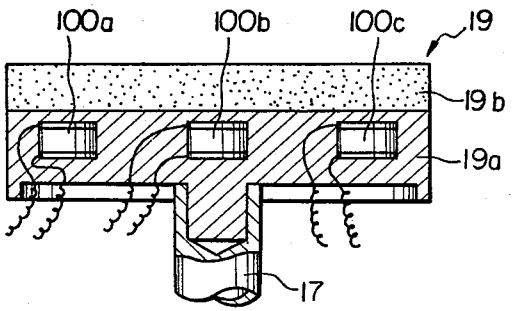
FIG. 5 is a side sectional view of the other embodiment of the mute assembly usable for the percussion instrument shown in FIG. 1.

The second embodiment of the mute assembly in accordance with the present invention is shown in FIG. 5, in which a mute assembly is internally provided with two or more sets of mechanical-electric converters arranged in a spaced side-by-side relationship to each other.

In the illustrated construction, a mute assembly 19 is provided with three sets of mechanical-electric converters 100*a*, 100*b* and 100*c* embedded in the substrate 19*a*. Each converter is comprised of a vibration responsive element, a pair of electrodes and electric leads coupled to a given signal processing circuit. With this construction, different converters respond to different vibrations generated at different portions of a common drum head. The leads from the first converter 100*a* are coupled to the input terminal 130*a* of a wave shape generating circuit shown in FIG. 6 and the output terminal 130*b* thereof is coupled to a VCO (not shown). The leads from the second converter 100*b* are coupled to the input terminal of a like but separate wave shape generating circuit and the output terminal thereof is coupled to a VCF or tone colour shaping circuit (not shown). The leads from the third converter 100*c* are coupled to the input terminal of a like but separate wave shape generating circuit and the output terminal thereof is coupled to a VCA (not shown).

Figure 6:
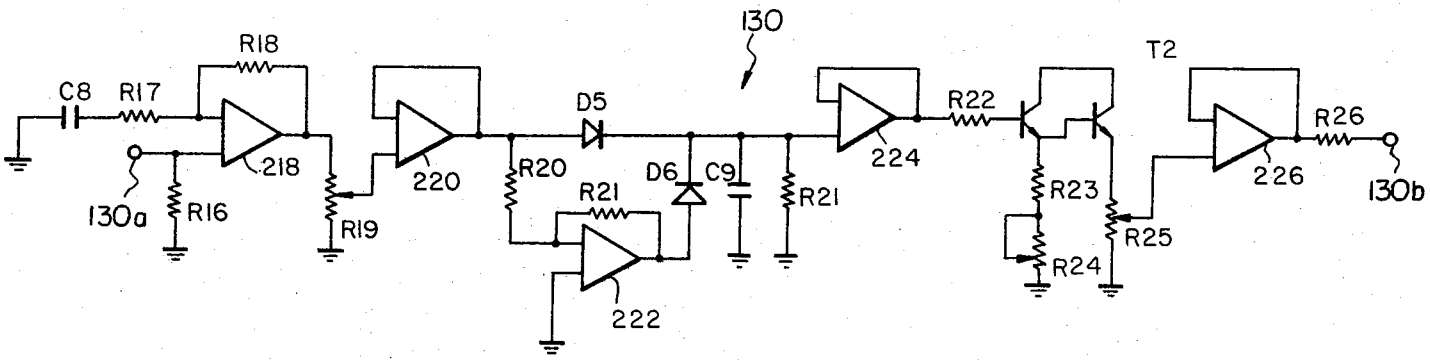
FIG. 6 is a circuit diagram of one example of the wave shape generating circuit used in combination with the mute assembly shown in FIG. 5.

As shown in FIG. 6, the output of mechanical-electric converter 100 is applied to one input of operational amplifier 218 via resistor R16. The remaining input of amplifier 218 is coupled to ground via capacitor C8 and resistor R17. Resistor R18 is placed in the feedback path of amplifier 218. The output of amplifer 218 is applied to one input of operational amplifier 220 via potentiometer R19. The remaining input of amplifier 220 is coupled to its output such that amplifier 220 operates as a voltage follower.

The output of amplifier 220 is applied both to the anode of a diode D5 and to one input of operational amplifier 222 via resistor R20. A resistor R21 is placed in the feedback path of amplifier 222 while the remaining input of amplifier 222 is grounded. The output of amplifier 222 is coupled to the anode of a diode D6. The cathodes of diodes D5 and D6 are connected to each other and to one input of operational amplifier 224 via a filter circuit including capacitor C9 and resistor R21. Amplifier 224 is coupled to operate as a voltage follower whose output is applied to the Darlington transistor pair T2 via resistor R22. The emitter of the input transistor of the Darlington pair T2 is coupled to ground via a resistor R23 and a potentiometer R24. The emitter of the output transistor of the Darlington transistor pair T2 is coupled to one input of amplifier 226 via potentiometer R25. Amplifier 226 is connected to operate as a voltage follower and is connected to the output **130*b* via resistor R26**.

In the above-described embodiment, the output terminals of the three separate wave shape generating circuits may be coupled to a common VCO, VCF or VCA in order to preclude uneveness in tonal effect which would otherwise result from differences in the position at which the drum sticks contact the drum head.

As a substitute for the single mute assembly containing a plurality of mechanical-electric converters, a plurality of mute assemblies may be used, each containing one mechanical-electric converter only. In this case, different mute assemblies are arranged facing different portions of the drum head surface. This is shown in phantom at 19'' of FIG. 1.

I claim:

1. An improved electric percussion instrument, comprising:

a cylindrical drum frame having an open end;

a drum head made of a flexible material and covering, in a stretched state, said open end of said drum frame;

a mute assembly including a rigid substrate and flexible mute element mounted on said substrate;

a mechanical-electric converter embedded in said substrate of said mute assembly and including a vibration responsive pickup element;

means for positioning said mute assembly in such a manner that said mute element faces one surface of said drum head;

manually adjustable means for urging said mute assembly towards said drum head such that said mute element is placed in tight pressure surface contact with said one surface of said drum head; and an electric signal processing circuit coupled to said mechanical-electric converter.

2. An electric percussion instrument as claimed in claim 1, wherein said one surface of said drum head is an outer surface of said drum head.

3. An electric percussion instrument as claimed in claim 1, wherein said one surface of said drum head is an inner surface of said drum head.

4. An electric percussion instrument as claimed in claim 1, further including a second mute assembly including a rigid substrate and a flexible mute element mounted on said substrate, said flexible mute element of said second mute assembly facing said drum head, said second mute assembly containing a mechanical-electric converter and facing a different position on said drum head than said first mute element.

5. An electric percussion instrument as claimed in claim 1, wherein said mute assembly includes a plurality of mechanical-electric converters embedded in said substrate, each of said mechanical-electric converters corresponding to a different position on said drum head.

6. An electric percussion instrument as claimed in claim 1, 2 or 3, wherein said mechanical-electric converter is fully embedded within said substrate.

7. An electric percussion instrument as claimed in claim 4 or 5, wherein each of said mechanical-electric converters is fully embedded within said substrate.

8. An electric percussion instrument as claimed in claim 1, wherein:

said substrate has a bulge projecting into said mute element; and said mechanical-electric converter is located primarily in said bulge.

9. An electric percussion instrument as claimed in claim 1, 2, 3, 4 or 5, wherein said vibration responsive pickup element is a piezoelectric element.

* * * * *